US009469959B2

(12) United States Patent
Maggio

(10) Patent No.: US 9,469,959 B2
(45) Date of Patent: Oct. 18, 2016

(54) FULL DISPLACEMENT PILE TIP AND METHOD FOR USE

(71) Applicant: Michael Maggio, Azusa, CA (US)

(72) Inventor: Michael Maggio, Azusa, CA (US)

( * ) Notice: Subject to any disclaimer, the term of this patent is extended or adjusted under 35 U.S.C. 154(b) by 0 days.

(21) Appl. No.: 14/184,115

(22) Filed: Feb. 19, 2014

(65) Prior Publication Data

US 2015/0233075 A1 Aug. 20, 2015

Related U.S. Application Data

(60) Provisional application No. 61/827,889, filed on May 28, 2013.

(51) Int. Cl.

| | |
|---|---|
| ***E02D 5/28*** | (2006.01) |
| ***E02D 5/56*** | (2006.01) |
| ***E21B 10/44*** | (2006.01) |
| ***E02D 7/22*** | (2006.01) |

(52) U.S. Cl.
CPC . *E02D 5/56* (2013.01); *E02D 7/22* (2013.01); *E21B 10/44* (2013.01)

(58) Field of Classification Search
CPC ..... E02D 7/22; E02D 7/02; E02D 5/56; E02D 5/72; E02D 5/801; E02D 27/50; E02D 5/48; E21B 10/44; E21B 10/42; E04H 12/2223
See application file for complete search history.

(56) References Cited

U.S. PATENT DOCUMENTS

| | | | | |
|---|---|---|---|---|
| 3,043,383 | A * | 7/1962 | Newbold | 175/383 |
| 3,422,915 | A * | 1/1969 | Watts | 175/388 |
| 4,156,471 | A * | 5/1979 | Wagner | E21B 7/006 175/310 |
| 4,623,025 | A * | 11/1986 | Verstraeten | 175/21 |
| 5,722,498 | A | 3/1998 | Van Impe | |
| 7,198,434 | B2 | 4/2007 | Blum | |
| 7,914,236 | B2 | 3/2011 | Neville | |
| 8,033,757 | B2 | 10/2011 | Stroyer | |
| 2006/0198706 | A1* | 9/2006 | Neville | 405/252.1 |
| 2011/0229272 | A1* | 9/2011 | Lindsay et al. | 405/253 |
| 2012/0195691 | A1 | 8/2012 | Dolly | |

* cited by examiner

*Primary Examiner* — John Kreck
*Assistant Examiner* — Carib Oquendo
(74) *Attorney, Agent, or Firm* — Flyer & Flyer, a professional LAW Corp; David R. Flyer

(57) ABSTRACT

The device is a Full Displacement Pile Tip (FDPT) with a sacrificial drill bit that is connected to a steel pipe, where the tip comprises at least four flanges or fish tails at the cutting edge extending from a conical, dome-like bottom, and integrally connected to the cutting teeth along the tip's axial shaft. The purpose of the FDPT is allow a steel pier to be screwed into the ground to serve as a foundation for a structure. This is a single operation where the FDPT and pipe remain in the ground. There is no removal of FDPT, minimal pouring of concrete, and there is minimal soil spoilage. A smaller drilling rig can be employed to save operating costs.

7 Claims, 6 Drawing Sheets

PLATE 4

FULL DISPLACEMENT PILE TIP AND METHOD FOR USE

CROSS-REFERENCE claim priority to a provisional application No. 61/827,889, filed May 28, 2013.

STATEMENT REGARDING FEDERAL SPONSORED RESEARCH

None.

PARTIES TO JOINT RESEARCH AGREEMENT

None.

BACKGROUND OF THE INVENTION

The Full Displacement Pile Tip (FDPT) is a drilling bit that is very effective in penetrating many types of soil in order to install a steel pier for building foundation support. The FDPT is so efficient in laterally displacing soil that the concrete required to supplement the installation is minimal and soil waste is minimal. This speeds up construction at reduced costs.

Support is crucial in the construction of a building. Where soil is loose or cannot be adequately compressed to support the building, then deep holes are drilled under the foundation and concrete is typically poured into holes for reinforcement. Further, where hardened bedrock is located beneath the building, then a very sturdy bit is required to penetrate the rock as an anchor.

There have been several improvements in the conventional installation of concrete foundation piles or piers. Cutting tips permit the piers to be installed in a single operation, rather than involving installation by vibration of the ground. Cutting tips minimize the need for pre-drilling a location. The entire pier is rotated as it is drilled into the ground. However, this tends to loosen the soil and actually reduces support. Additionally, different soil compositions and hole depths create challenges for these drilling tools.

To address the concerns of soil loosening, devices such as a hollow stem auger with a tapered shaft to allow for simultaneous injection of concrete with a full displacement body are sometimes used. These augers have outward flights over a tapered section so as to compact the surrounding soils. Auger pressure grouting with displacement provides advantages because injecting the grout under pressure creates relatively high bearing capacities, promotes relatively fast construction, and lateral displacement of the soil minimizes spoilage disposal since compacting the soil laterally tends to improve the soil strength. Lateral displacement is achieved by auger bits with tapered stems, which tend to force the displaced soil laterally outward. Operations utilizing these methods must extend to considerable depths, making wear-resistance an important feature of bit design. An example is shown in U.S. Pat. No. 7,198,434, which discloses an auger bit with anti-wear protrusions that traps soil in protective positions on the stem and flighting for protection from wear. However, this device and method require auger extraction when pumping grouting material. Extraction involves additional time and creates some spoilage.

Another method involves a detachable end plate on the design tip depth, with injection of concrete. The soil is first displaced laterally around the pier. Then, upon reaching the design tip depth, a center bar is placed inside the drill stem and filled to a level above ground with concrete. During extraction, the left-handed flight above the displacement body picks up any caved material and re-compacts it back into the soil. The soil is prevented from decompressing by the pressure from the displacement body, in addition to the hydrostatic pressure from the concrete in the stem. The disadvantage is again time because several steps are involved, including drilling, and then center bar installation prior to concrete pumping.

Piers can also be installed using high torque hydraulic drilling rigs which rotate a specialized displacement tool into the ground, causing the ground to be compacted. Although, these processes provide deep foundation support and eliminate some of the high costs and delays related to disposing of contaminated soil, flights are required to go all the way up the drill shaft for displacement purposes. Having flights all along the shaft increases spoilage. Moreover, these methods require concrete to be poured immediately.

Another remedy for the lack of support of the pier is to inject grout around the pier to fill up the space caused by loosened soil. This too presents support problems because it is difficult to inject grout in a uniform and controlled manner and may even overly compress the surrounding soil. One known method involves displacing soil outwardly and then simultaneously filling the resulting void with grout around the pier. Though this device solves part of the problem by increasing productivity, it also requires immediate injection of grout, causes spoilage, and does not account for tougher drilling projects which require a sturdier drill tip.

To avoid concrete injection, an advance in driving and drilling systems where the drill tip must be retrieved from the drilling site after drilling is complete is shown in U.S. Pat. No. 7,914,236, which discloses a tubular shaft with two cylindrical sections and a helical flight attached to an exterior surface of the tapered portion. But, the problem with the flat surface perpendicular to the centerline of the tubular pile, is that the flat surface generates heat. When heat is generated at the pile tip it begins to melt the tip, which may cause the whole pier to collapse or worse, to grossly deform the surrounding soil resulting in potential future problems.

Another device for an improved drill tip involves a pier attachment structure with a diameter no greater than the width of the pier and a soil penetrating body having a plurality of circular stepped flights forming the shape of a descending continuous conic spiral organized around a center axis. However, this conical spiral at the tip meets a flat bottom at the base, which also generates too much heat.

The problem with all of the foregoing drill tips is that they need to be replaced as they get worn down from frequent bearing into hard soil with high rock content and/or they require concrete pumping to correct for deficiencies. Multiple steps in the drilling and installation of piers increase costs, result in delays, require heavier drilling rigs, and impose an obligation to remove and transport the extracted soil.

Currently the methods for improving drill tips without concrete injection, focus on the power of the drilling rig to force the shaft into the hole and have not sufficiently increased the durability of the drill tip. Therefore, there is a need to improve the strength of the drill tip to allow higher penetration in firm soil and to allow smaller and less expensive drilling rigs to accomplish the task. Less wear points also will decrease the amount of heat generated at the tip to prevent melting. My invention solves these problems by creating a device which comprises a conical shape to reduce heat, more steel at the cutting edges to abate wear— specifically, at least four flanges or "fish-tails" at the cutting edges—and tapered flights with thickened steel to improve cutting and minimize spoilage. The drill tip is actually left in the ground with the pier, so minimal concrete is required, and there is no extraction creating spoilage.

Further, my device has self-aligning capabilities. This is important because the tip is very heavy, so features which facilitate manual handling of the drill tip improve operations by saving time.

SUMMARY OF THE INVENTION

The invention comprises a Full Displacement Pile Tip with an improved and stronger drill tip compared to existing displacement pile tips. There is increased amount of steel at the leading edge which makes initial contact with the soil by doubling the number of cutting blades to at least four. These cutting blades are referred to as "fish-tails" because they look like the back of a fish as they penetrate the ground. Also, my invention increases the size and number of teeth on the head and thickens the steel on the edges of the teeth. Further, the conically shaped drill tip has a more severe angle of impact to reduce heat. The invention is streamlined. The FDPT causes lateral soil displacement. It works in a single operation where a sacrificial end penetrates the soil for the steel shaft. The shaft is left in the ground and no concrete is required. This permits use of smaller and less expensive drilling rigs.

Further, the invention has two integral features installed during the manufacturing process: (1) a picking eye on the middle flight, and (2) three tabs at the top end. The picking eye is a centering device that allows the FDPT to be mechanically hoisted. This eases manual handling of the heavy drill tip. The tabs assist in aligning the FDPT to the steel pipe for purposes of welding, where centering points installed during the fabrication process are used to correctly align the top of the tip exactly where welding to the shaft is required.

The existing state of the art reveals that other full displacement pile tips rely on a substantial amount of power of the drilling rig to force the shaft into the hole. My invention employs more steel at the cutting edge and on the axial shaft, as well as a conical shape to permit smaller and less expensive drilling rigs to accomplish the task of drilling and installation.

DETAILED DESCRIPTION OF A PREFERRED EMBODIMENT

Figure 1:
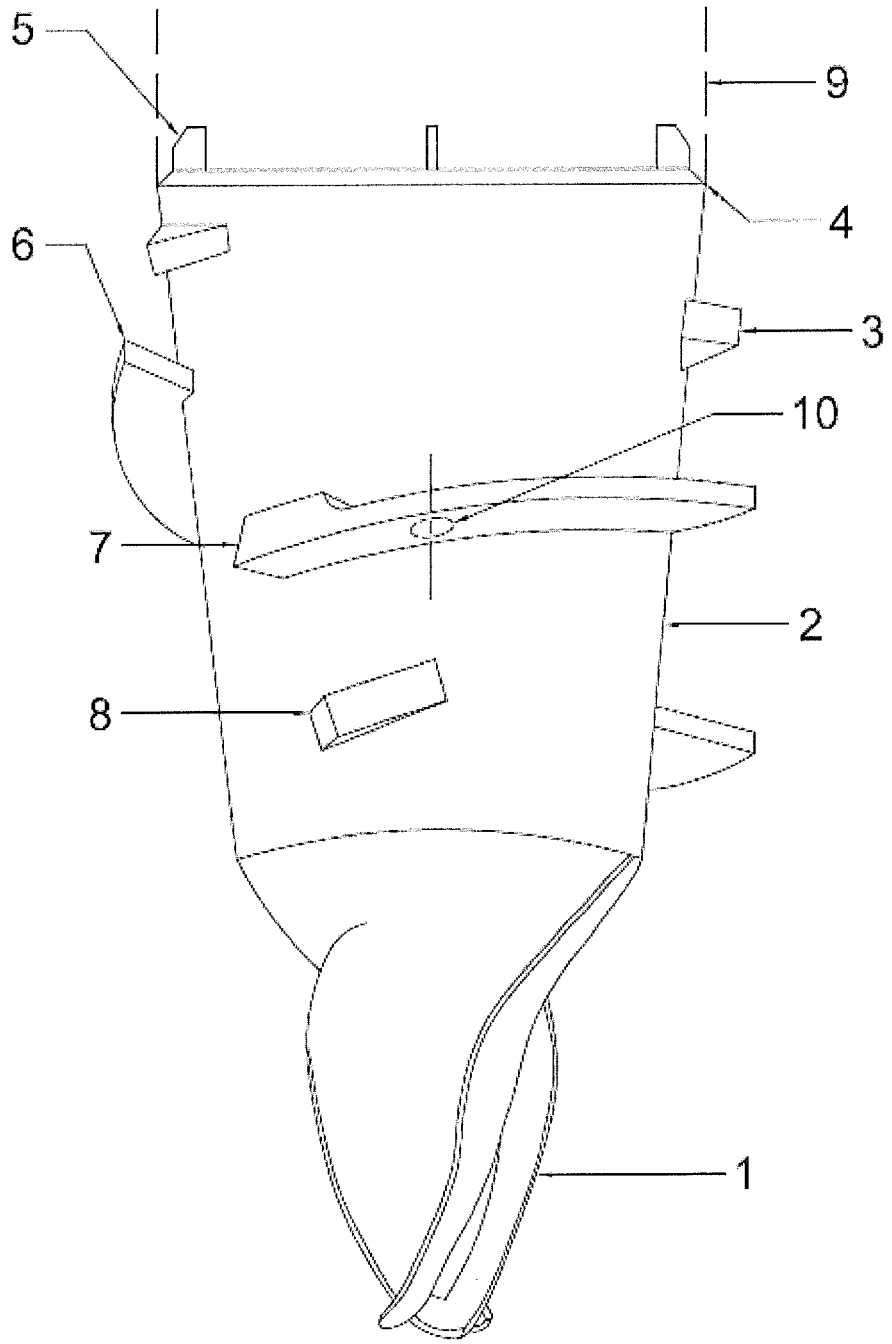
FIG. 1 is a cross-sectional view of the pile tip oriented for drilling into the soil.
Figure 2:
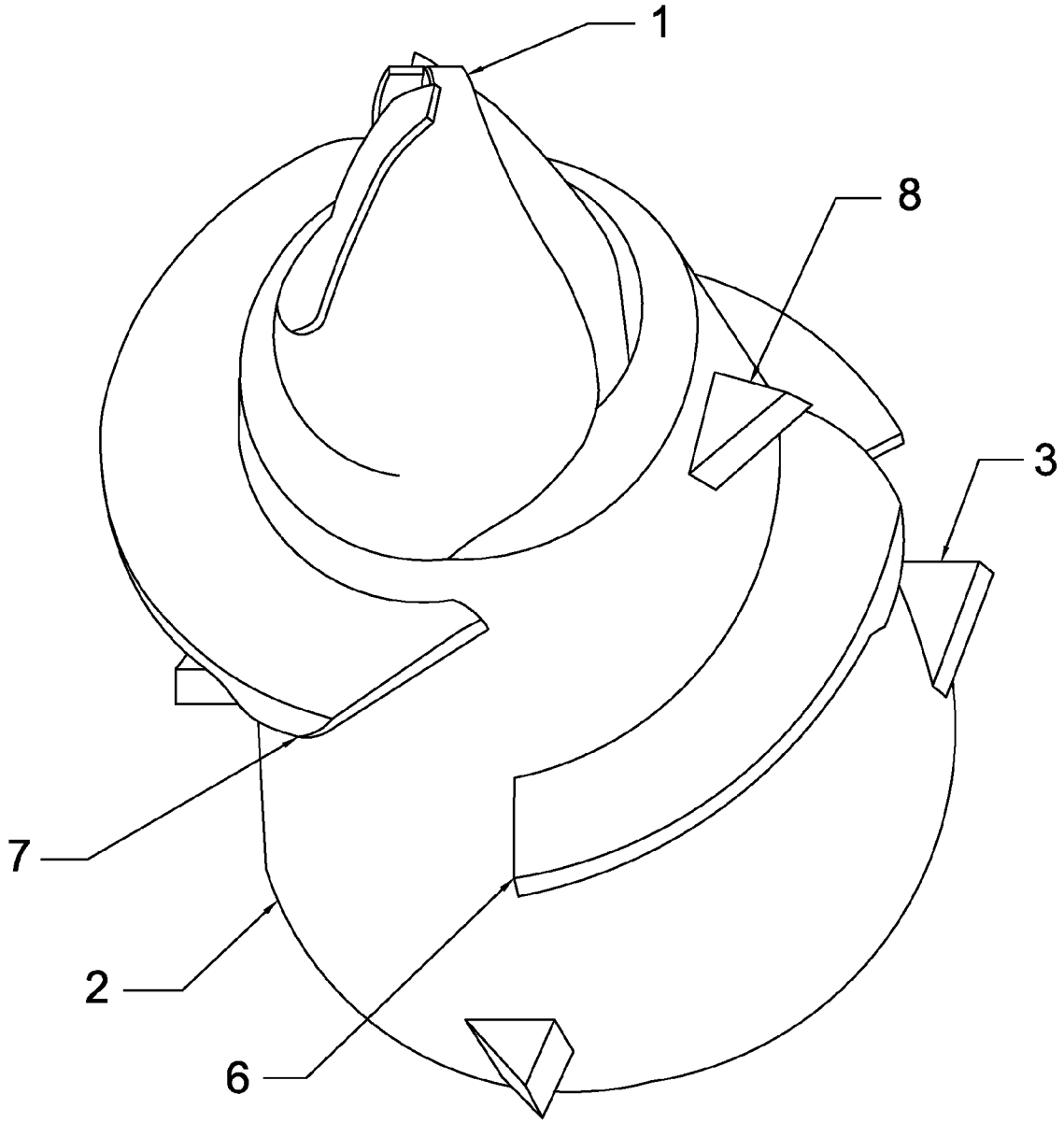
FIG. 2 is an oblique view of the business end of the pile tip from the point of view of the ground looking upward.
Figure 3:
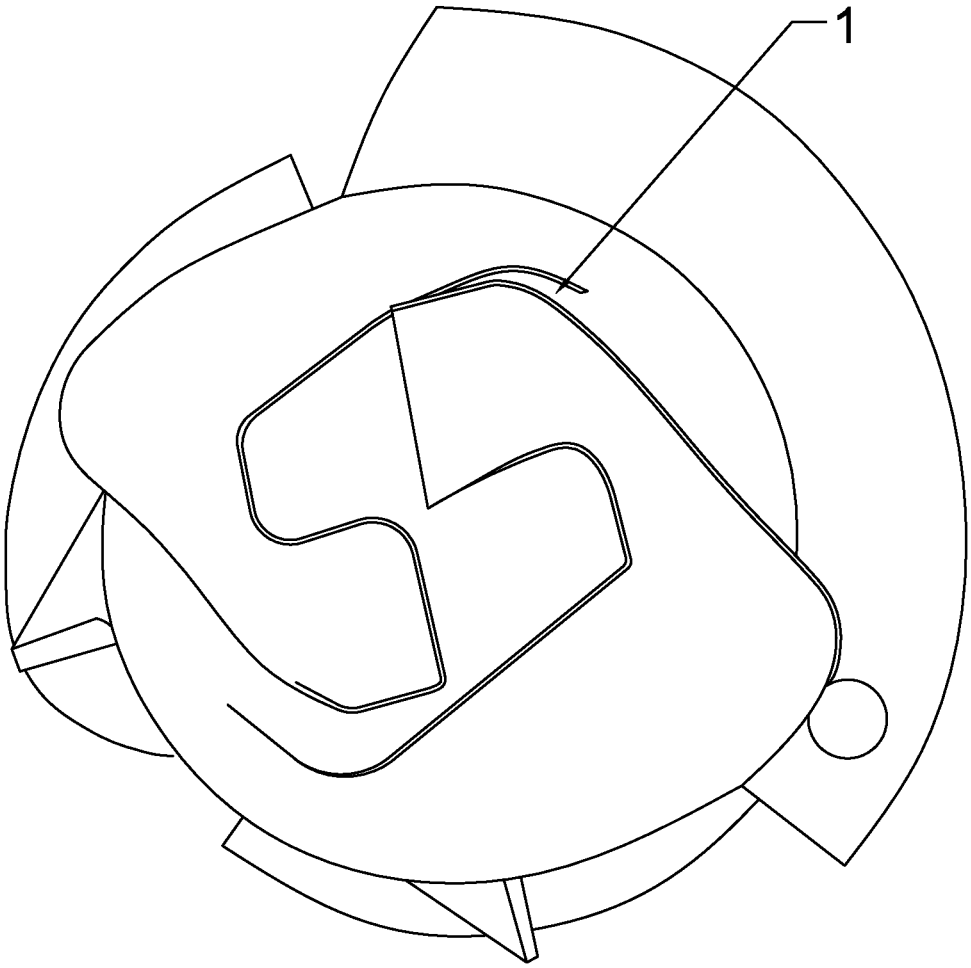
FIG. 3 is a cross-sectional view of the pile tip from the ground looking upward to display the four fish-tails.

A FDPT constructed of steel from top to bottom prevents fracturing and saves costs. The FDPT contains at least four-fish tails 1 which means that a hardened steel tip with more steel is at the initial penetration point into the ground. The fish tails are at the cutting end of the drill tip. Two piece steel casting 2 is more cost efficient than rolled steel. The FDPT is attached to a steel pile 9 (not part of the invention) and screwed into the ground. The whole apparatus including the FDPT and steel pier stays in the ground preventing the hole from caving in. The operator simply drills the FDPT and steel pier into the ground and disconnects. Because the whole apparatus is left in the ground, shorter piers can be used, and less time is consumed. "Pier" and "pile" mean the same thing.

Steel teeth can be arrayed in three flights called cutting teeth, 3, 6 and 8, with the lower flight 8, the middle flight 6, and the upper flight 3. The flights of teeth are wider at the cutting edge and narrower toward the drill FDPT, creating additional clearance to produces better suction between the pier and the ground. Traditional pier tips cut too much clearance preventing adequate suction. The flights of teeth are doubled in width on the leading edge with an optimal angle. Doubling the width at the leading edge of the flights increases durability, efficiency and reduces the likelihood of the getting stuck in the ground.

In a preferred embodiment, the flights of cutting teeth 3, 6 and 8, are arrayed on the three separate flights welded or casted to the axial shaft with a 6.5 inch pitch 7. Screwing the pile into the ground causes lateral displacement, which improves the soil strength. There are no flights on the steel pier itself because the FDPT is strong enough to pull the pier down. This saves time because it is a single operation and decreases the amount of spoilage to a negligible amount.

The FDPT is strengthened by employing more steel at the fish tails 1 to allow deeper penetration into firm soil. At least four fish tails 1 at the cutting edge of the full displacement pile tip increase the aggressiveness for improved soil penetration. The four fish tails 1 extend from a conical, dome-like bottom allowing for a higher tolerance to high pressure and heat. The base angle of the FDPT 4 is beveled to 45° to improve the conical shape and streamline penetration into the ground. The four fish tails 1 effectively navigate through rocks and pull the pier tip down into the soil locking it in place.

The method for installation of piers or full displacement piles comprises placing the FDPT on the ground, then hoisting the drill tip above the ground by its picking eye 10, which picking eye is installed during fabrication and then aligning it to a steel pier 9. The picking eye eases manual handling of a very heavy FDPT. Next the FDPT is welded to one end of a steel pile 9. To facilitate welding, during fabrication of the tip, three tabs 5 are located. The FDPT with the steel pier assembly is raised by a drilling rig. The tip and steel pier assembly is then screwed into the ground. After the full length of steel pier is screwed into the ground, the drilling rig releases its support, leaving the FDPT with the steel pier assembly in the ground.

The full displacement pile tip is placed on reasonably flat ground. Then a drilling operator for a drill rig truck, connects a cable at a picking eye 10 on the drill tip, raises up the drill tip, and aligns it to a steel pier 9. The drill tip and steel pier are welded together. The connected drill tip and steel pier is called a steel pier assembly or assembly. The assembly is lifted at an end away from the business end which is to be inserted into the ground, by a supporting means, typically a drill rig truck. The assembly is raised to a vertical position over a location for insertion of the assembly into the ground. Then the assembly is rotated in drilling manner to insert the assembly into the ground. After insertion, the assembly is released from the drill rig truck.

Figure 4:
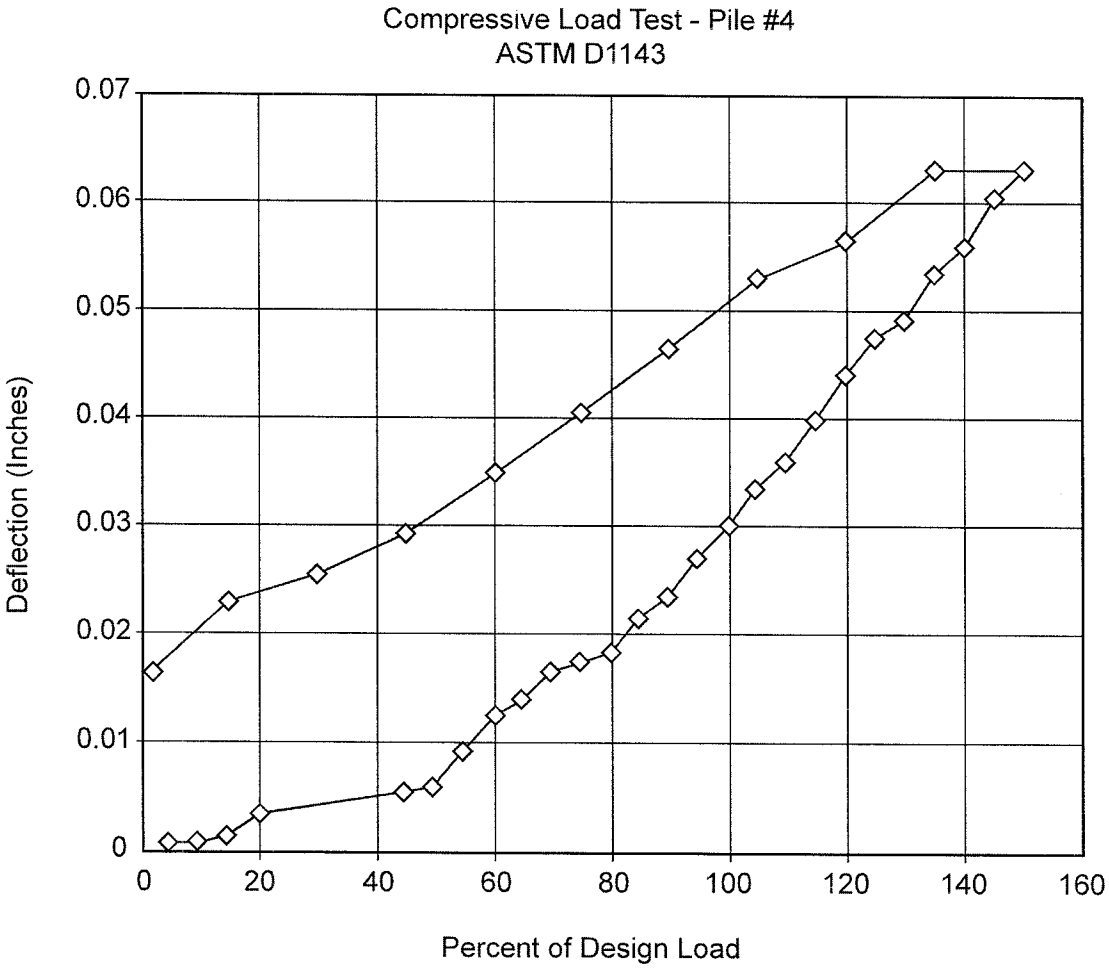
FIG. 4 is Larkspur, Calif., Comprehensive Load Test

Actual site data collected by geotechnical engineers demonstrates the efficacy of the FDPT. Two projects are discussed. At a reinforcement project in Larkspur, Calif., the soil was described as relatively weak, porous and subject to settlement under foundational loads. Further, the area was at risk for seismic activity. Building support was to be provided by cast-in-place, reinforced concrete piers or full displacement piles. My invention was selected using full displacement piles. The engineering requirement called for the drilled piers to be at least 18 inches in diameter and installed at least 8 feet into bedrock. Using the FDPT, a total of eight 12¾ inch full displacement piles were installed ranging in depth between 17½ feet and 19 feet, and advanced into bedrock to achieve refusal installation torques. The design load was 78 kips with measured deflection not to exceed 0.065 inch. Load testing conducted in accordance with ASTM D1143, on one pier confirmed that the pier capacity was approximately 260 kips (three times design requirements). The test data appears at FIG. 4.

Figure 5:
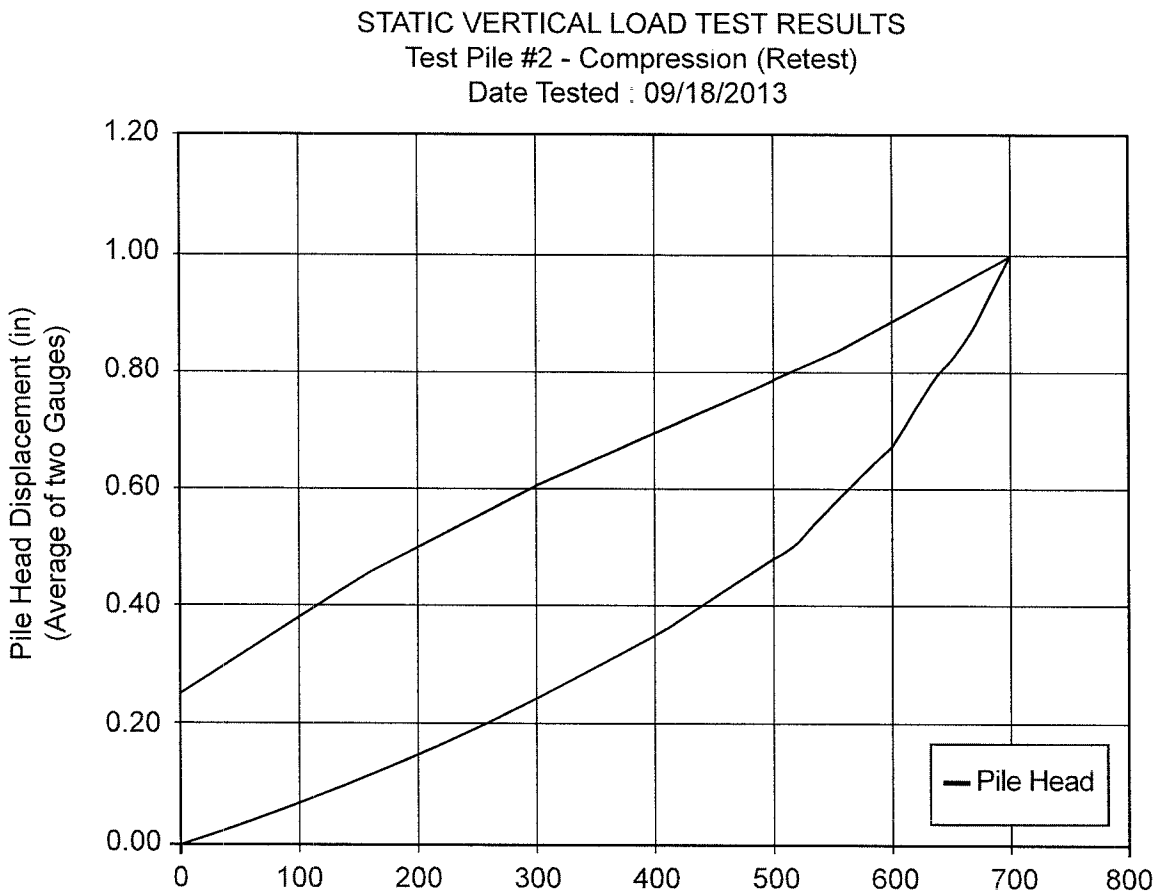
FIG. 5 is Compton, Calif., Static Vertical Load Test (55')
Figure 6:
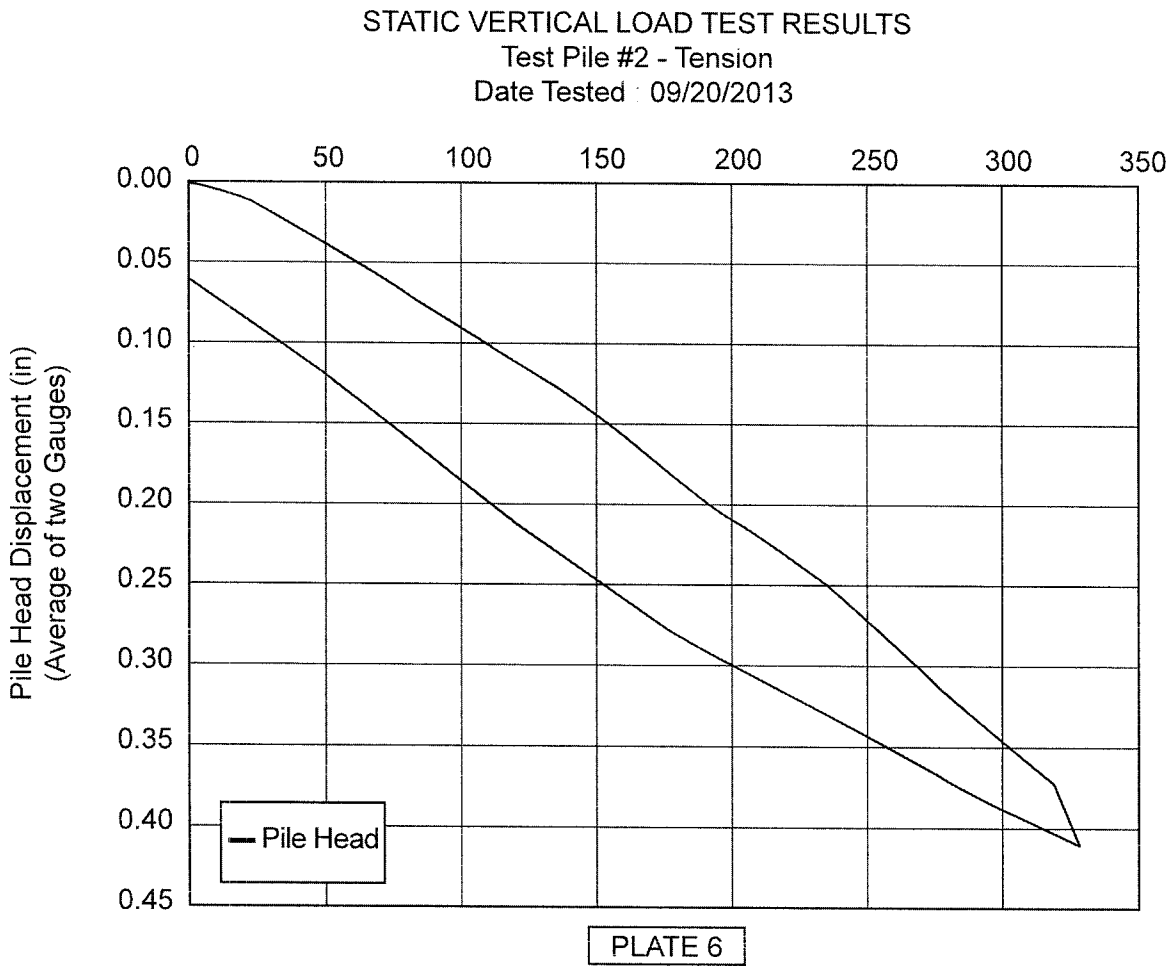
FIG. 6 is Compton, Calif., Static Vertical Load Test (35')

At the second project in Compton, Calif., two static vertical tests were conducted, at 35' and 55' depths. Using the procedures described in ASTM D1143 and D3689, the maximum deflection observed was approximately 0.999 inch under 700 kips load, with 0.632 inch under 300 kips load. The test data at 55' depth appears at FIGS. 5 and 6.

During fabrication, self aligning capability is provided for the FDPT. A picking eye 10 is located in the middle flight 6 to allow balanced alignment when hoisting the tip for welding fabrication onto the steel pipe. Also, during fabrication, three centering tabs 5 are marked to correctly align the tip exactly where welding to the steel pier is required.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A full displacement pile tip for creating and then serving as a left in-place foundation for structures, comprising:

a conically shaped steel drill tip, with at least four cutting teeth referred to as "fish tails" integrally connected to, arrayed at equidistant angles from one another, and extending downward from a dome-like bottom end of a steel pier to which it is welded, with steel cutting teeth integrally connected to and around the drill tip, wherein the steel cutting teeth are arrayed on three separate integrally connected flights comprising a lower flight, a middle flight and an upper fight, and wherein there is a one inch diameter picking eye integrally drilled into the middle flight to permit balanced alignment when hoisting the drill tip for welding onto a steel pier which will serve as the foundation for the structure.

2. The full displacement pile tip of claim 1 wherein three separate flights of teeth are welded or casted with a 6.5 inch pitch.

3. The full displacement pile tip of claim 1 wherein a leading edge of each of the three separate flights of teeth is one inch thick at an outside edge and tapered to one-half inch thick at a trailing edge.

4. The full displacement pile tip of claim 1 wherein the composition of steel is ⅜" cast or rolled steel.

5. The full displacement pile tip of claim 1 wherein there is a 45 degree bevel at bottom of the drill tip where it connects to the steel pier.

6. The full displacement pile tip of claim 1 wherein there are three centering tabs installed on top of the drill tip, to allow ease of connection to the steel pier.

7. A method for placing a full displacement pile in a supporting medium comprising the steps of:

placing a full displacement pile tip having a conically shaped steel drill tip, with four cutting teeth integrally connected to, arrayed at equidistant angles from one another, and extending downward from a dome-like bottom end of the drill tip, where steel cutting teeth are integrally connected to and threaded around the drill tip, which is laying on reasonably flat ground, wherein the steel cutting teeth are arrayed on three separate integrally connected flights comprising a lower flight, a middle flight and an upper fight, and wherein there is a one inch diameter picking eye integrally drilled into the middle flight to permit balanced alignment when hoisting the drill tip for welding onto a steel pier which will serve as the foundation for the structure, hoisting the pile tip above the ground at a picking eye and aligning the pile tip to a steel pier, welding the pile tip to one end of the steel pier, creating a steel pier assembly or assembly, placing the pile tip with the steel pier assembly on a supporting means, affixing an end of the steel pier which is not welded to the pile tip, to a drilling rig, lifting the assembly to a vertical position, screwing the pile tip and the steel pier into the ground, releasing the drilling rig from the pile tip and the steel pier, and leaving the pile tip with the steel pier assembly in the ground.

* * * * *